US005675918A

United States Patent [19]

Harrod et al.

[11] Patent Number: 5,675,918

[45] Date of Patent: Oct. 14, 1997

[54] SHIRT CUFF PRESSING ASSEMBLY

[75] Inventors: Michael K. Harrod, Valrico; Charles E. Devrick, Tampa, both of Fla.

[73] Assignee: Unipress Corporation, Tampa, Fla.

[21] Appl. No.: 694,777

[22] Filed: Aug. 9, 1996

[51] Int. Cl.[6] ..... D06F 71/24

[52] U.S. Cl. ..... 38/66; 223/52.1

[58] Field of Search ..... 38/17, 20, 4, 5, 38/66, 16, 71, 64; 223/57, 70, 72, 52.1, 52.5, 52.6

[56] References Cited

U.S. PATENT DOCUMENTS

| | | | |
|---|---|---|---|
| 2,136,564 | 11/1938 | Ricketson | 38/66 |
| 2,325,907 | 8/1943 | Downer et al. | 38/66 X |
| 2,743,853 | 5/1956 | McLagan | 38/66 X |
| 2,810,219 | 10/1957 | Craig | 223/72 X |
| 4,634,030 | 1/1987 | Uchikoshi | 223/57 |
| 4,843,745 | 7/1989 | Oberley | 38/34 |

OTHER PUBLICATIONS

Model STHG Power Press Brochure, Form No. U-331, Dec. 14, 1962.

*Primary Examiner*—Ismael Izaguirre

*Attorney, Agent, or Firm*—Stein, Pendorf & Van Der Wall

[57] ABSTRACT

A shirt cuff pressing assembly comprising an upper and lower cuff chest. The cuff chests have a forwardly protruding pressing surface defined by a protruding portion and a cut-out portion in which the cuff and pleated portion of a shirt sleeve may lay flat. The cut-out portion provides relief for the unpleated portion of a sleeve so that it is not pressed and the protruding portion allows the pleated portion of the sleeve to be pressed upon closure of the upper and lower cuff chests.

20 Claims, 5 Drawing Sheets

SHIRT CUFF PRESSING ASSEMBLY

BACKGROUND OF THE INVENTION

1. Field of the Invention

The present invention relates to shirt pressing assemblies for finishing shirt cuffs. This invention more particularly pertains to a shirt cuff chest for finishing the shirt cuff as well as the pleated portion of a shirt sleeve.

2. Description of the Background Art

Presently, there exists many varieties of commercially available shirt cuff pressing assemblies. However, no known pressing assemblies can simultaneously finish the cuff and the pleated portion of a sleeve adjacent to the shirt cuff in an effective manner because most shirts with cuffs have more material in the base of the sleeves than in the cuffs. When manufacturing a shirt, the extra material in the sleeve is gathered at the base of the cuff in the form of a pleat. Typically, the cuff and the pleated portion of the sleeve must be pressed separately in order to obtain an effective finish.

A cuff pressing assembly typically comprises a lower cuff chest and an upper cuff chest with each having a pressing surface. The pressing surfaces of the cuff chests are typically arched shaped and heated by a heat transfer media such as steam, oil or electricity. The shirt cuff is laid on the pressing surface of the lower cuff chest. To finish the shirt cuff, the upper cuff chest is mated with the lower chest cuff with the shirt cuff sandwiched in between the pressing surfaces. A shirt cuff chest with this configuration will only effectively finish the cuff of the shirt. The portion of the sleeve immediately adjacent the cuff will not be effectively finished. Therefore, the pleats on a shirt sleeve adjacent to a shirt cuff will be either unfinished or they will be wrinkled.

Some prior art cuff chests include the pressing surface with a forward protrusion. The disadvantage associated with such a shirt cuff chest is that a shirt sleeve may not be properly fitted upon a lower cuff chest with such a configuration, thereby resulting in an improper fit wherein the extra material in the sleeve is not properly flattened against the chest. Moreover, the pleated portion of the sleeve will not lay flat on the chest. In an attempt to remedy the disadvantages of this latter cuff chest, the sides of this chest could be narrowed, thus creating a taller chest with steeper sides. However, the overall effectiveness in finishing the shirt cuffs is then diminished due to greater pressure being placed on the top of the chest than on the steeper sides of the chest when pressing a shirt cuff. An example of this known configuration of a cuff chest is that utilized in Model STHG for finishing collars and cuffs manufactured by the Unipress Corporation of Tampa, Fla.

U.S. Pat. No. 4,634,030 teaches a pair of base plates for receiving the tack sections of shirt sleeves. A base plate is inserted through the opening of each sleeve. The tack sections of the shirt are press clamped between heater plates and the base plates. One of the disadvantages associated with this device is that only the sleeve is pressed. To then press the cuff, a second operation is required in addition to the pressing of the sleeve. Similarly, other sleeve pressers are well known throughout the industry which require at least two distinct operations to effectively finish both the cuff and the pleated portion of a sleeve.

In response to the realized inadequacies of these earlier devices for finishing the cuff and pleated portion of a sleeve, currently there is a need for a shirt cuff pressing assembly that allows for the cuff as well as the pleated portion of a shirt sleeve to lay substantially flat against the pressing surface on the cuff chest so that the cuff as well as the pleated portion of the sleeve may be pressed. Inasmuch as the art consists of various types of shirt cuff pressing apparatus, it can be appreciated that there is a continuing need for and interest in improvements to cuff chests, and in this respect, the present invention addresses these needs and interests.

Therefore, the principal object of this invention is to provide an improvement which overcomes the aforementioned inadequacies of the prior art devices and provides an improvement which is a significant contribution to the advancement of the cuff finishing art.

Another object of this invention is to provide a new and improved cuff chest which has all the advantages and none of the disadvantages of the earlier cuff chests.

Still another objective of the present invention is to provide a shirt cuff pressing assembly capable of efficient finishing of the cuff and the pleated portion of a sleeve.

Yet another objective of the present invention is to provide a shirt cuff pressing assembly that while finishing the cuff and sleeve pleats, it concurrently provides for the gathering of the extra material of a sleeve so that the unpleated portion of the shirt sleeve is not pressed.

Still a further objective of the present invention is to provide a shirt cuff pressing assembly for pressing a shirt cuff and adjacent sleeve portion of a shirt, the sleeve portion having a pleated portion and an unpleated portion, the shirt cuff pressing assembly comprising a lower and an upper cuff chest, the lower and upper cuff chests having mating arch-shaped pressing surfaces allowing the lower cuff chest to be dressed with the shirt cuff and the shirt cuff pressed by the pressing surfaces upon mating closure of the cuff chests and the pressing surfaces of the cuff chests including forwardly protruding pressing surfaces, the forwardly protruding pressing surface of the lower cuff chest being defined by a protruding portion and a cut-out portion, the cut-out portion providing relief for gathering of the unpleated portion of the sleeve portion when the lower cuff chest is dressed with the shirt cuff, thereby allowing the pleated portion of the sleeve portion to be pressed by the forwardly protruding pressing surfaces of the cuff chests upon closure of the cuff chests without pressing of the unpleated portion of the sleeve portion.

Yet a further objective is to provide a method of pressing a shirt cuff and adjacent sleeve portion of a shirt, the sleeve portion having a pleated portion and an unpleated portion, the method comprising the steps of placing the shirt cuff on a shirt pressing assembly comprising a lower and an upper cuff chest, the lower and upper cuff chests having mating arch-shaped pressing surfaces allowing the lower cuff chest to be dressed with the shirt cuff and the shirt cuff pressed by the pressing surfaces upon mating closure of the cuff chests and the pressing surfaces of the cuff chests including forwardly protruding pressing surfaces, the forwardly protruding pressing surface of the lower cuff chest being defined by a protruding portion and a cut-out portion, the cut-out portion providing relief for gathering of the unpleated portion of the sleeve portion when the lower cuff chest is dressed with the shirt cuff, thereby allowing the pleated portion of the sleeve portion to be pressed by the forwardly protruding pressing surfaces of the cuff chests upon closure of the cuff chests without pressing of the unpleated portion of the sleeve portion, aligning the pleated portion on the protruding portion, gathering the unpleated portion at the cut-out portion, closing the upper and lower cuff chests such that the pressing surfaces are mated, pressing the shirt cuff and the pleated portion without pressing the unpleated portion of the sleeve portion and opening the upper and lower cuff chests such that the pressing surfaces are no longer mated, whereby the shirt cuff and the sleeve portion may be removed from the shirt cuff pressing apparatus.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to a device that satisfies this need for simultaneously pressing a shirt cuff and pleats in a shirt sleeve in an efficient manner. For the purpose of summarizing the invention, the invention comprises a lower and an upper cuff chest wherein each has an opposing pressing surface heated by a heat transfer media. The lower and upper cuff chests are arch-shaped. The upper cuff chest mates with the lower cuff chest such that the pressing surface of the lower cuff chest faces the pressing surface of the upper cuff chest. A shirt cuff and adjoining portion of the sleeve is dressed to the pressing surface of the lower cuff chest and upon mating closure of the upper cuff chest to the lower cuff chest the shirt cuff and pleated portion of the sleeve are finished.

The pressing surfaces of the cuff chests include a forwardly protruding pressing surface. This pressing surface is defined by a protruding portion and a cut-out portion. The protruding portion allows the pleated portion of a shirt sleeve to lie flat upon the lower cuff chest. The cut-out portion provides a relief for the unpleated portion so that upon closure of the upper cuff chest with the lower cuff chest the pressing surfaces press the cuff and the pleated portion of the sleeve without pressing the unpleated portion of the shirt sleeve. In an alternative embodiment, the forwardly protruding pressing surface of the upper cuff chest is also defined by a protruding portion and a cut-out portion.

The present invention is also directed to a method of pressing a shirt cuff and adjacent sleeve portion of a shirt. The first step is to place a shirt cuff on the shirt pressing assembly of the present invention. Next, the pleated portion on the sleeve is aligned with the protruding portion of the lower cuff chest. Then any extra material in the unpleated portion of the shirt sleeve is gathered at the cut-out portion of the cuff chest. After the extra material is gathered away from the pressing surfaces, the upper and lower cuff chests are closed such that the pressing surfaces are mated. The shirt cuff and pleated portion of the sleeve are then pressed between the pressing surfaces without pressing the unpleated portion of the sleeve. Finally, the upper and lower are opened to allow removal of the shirt cuff and sleeve. Also, the method of the present invention includes placing a shirt cuff and sleeve on a shirt cuff pressing assembly comprising an upper cuff chest that also includes a cut-out portion to provide relief for the unpleated portion of the shirt sleeve.

An important feature of the present invention is that is that the cut-out portion allows for the extra material which exists at the base of a shirt sleeve near the shirt sleeve cuff to be gathered out of the way of both of the upper and lower pressing surfaces. Therefore, it can be readily seen that the present invention provides a means to simultaneously finish a shirt sleeve cuff as well as the pleats in a shirt sleeve. Thus, the shirt cuff pressing assembly of the present invention would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENT

Figure 2A:
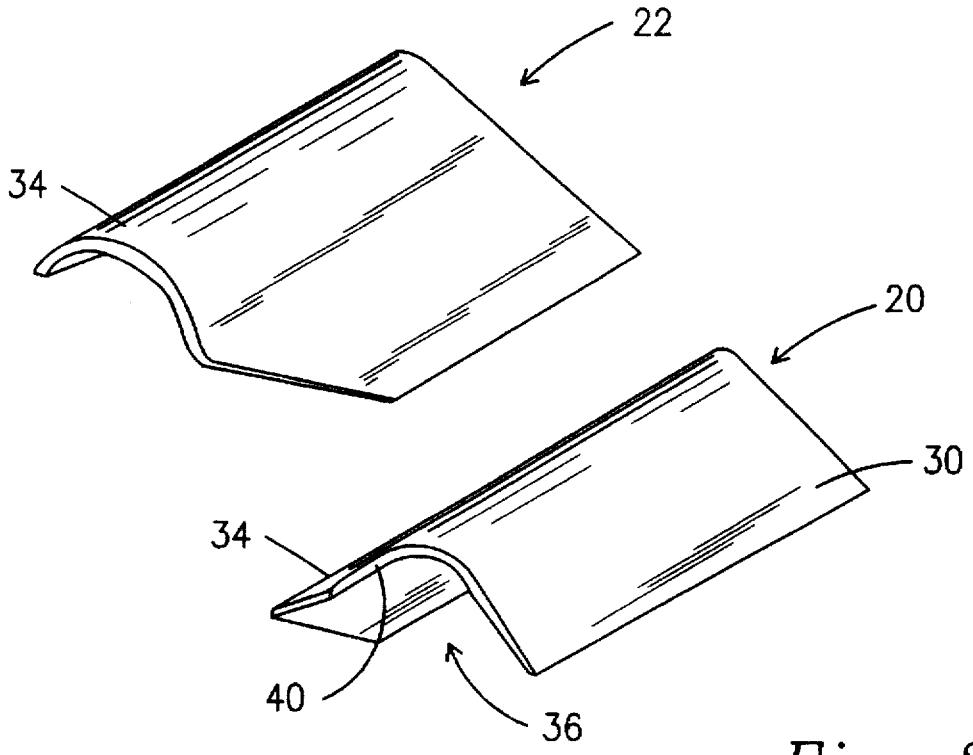
FIG. 2A is a perspective view of lower and upper cuff chests of the invention to finish a cuff and pleats on a left shirt sleeve wherein the pressing surface of the lower cuff chest includes a cut-out portion.
Figure 2B:
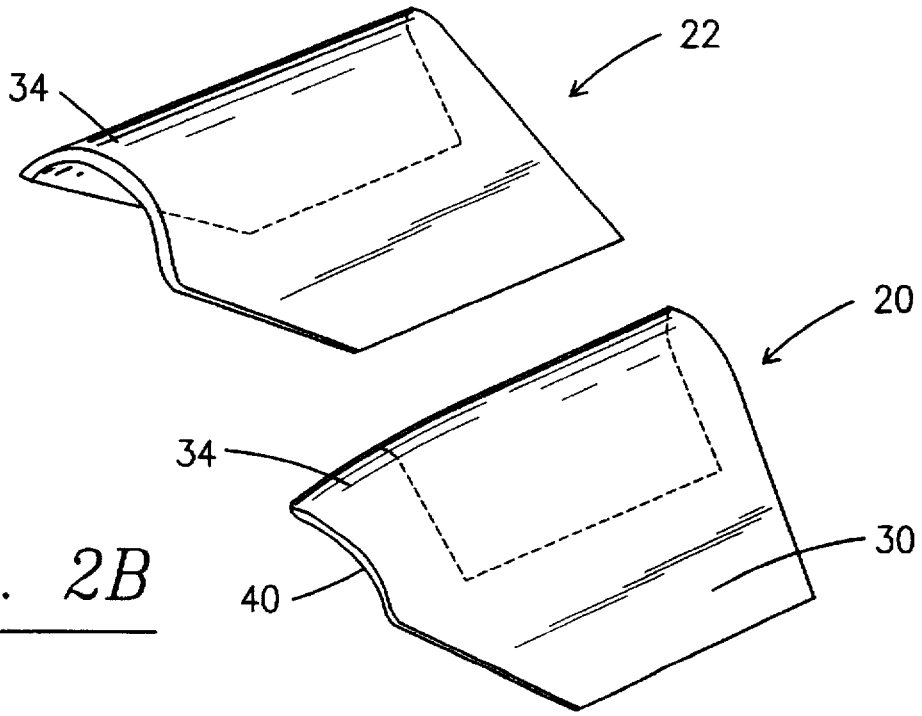
FIG. 2B is a perspective view of lower and upper cuff chests of the invention to finish a cuff and pleats on a right shirt sleeve wherein the pressing surface of the lower cuff includes a cut-out portion.
Figure 2C:
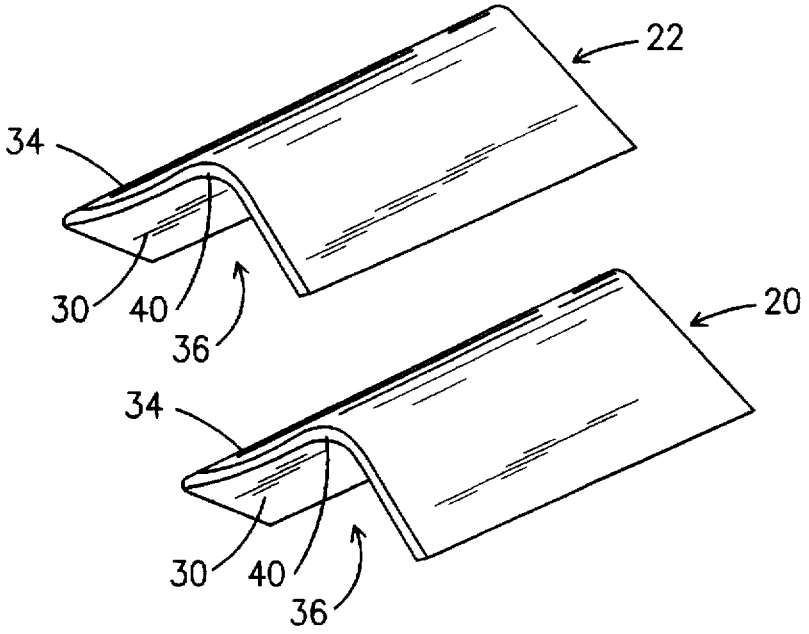
FIG. 2C is a perspective view of lower and upper cuff chests of the invention wherein the pressing surface of each cuff chest includes a cut-out portion.

With reference to the drawings, and in particular to FIGS. 2A, 2B and 2C thereof, a new and improved shirt cuff pressing assembly embodying the principles and concepts of the present invention and generally designated by the reference number 10 will be described. As shown in FIGS. 2A, 2B and 2C, the shirt cuff pressing assembly 10 comprises a lower cuff chest 20 and an upper cuff chest 22. Each of the cuff chests 20 and 22 include an arch-shaped pressing surface 30. The arch-shaped pressing surface 30 of the upper cuff chest 22 mates over the top of the arch-shaped pressing surface 30 of the lower cuff chest 20. The arch-shaped pressing surface 30 includes a forwardly protruding pressing surface 30. The arch-shaped pressing surface 30 allows the shirt cuff 8 to be pressed when the cuff chests 20 and 22 are closed together. The advantage associated with this configuration is that the forwardly protruding pressing surface 30 provides a platform on which the shirt cuff as well as the pleated portion of a shirt sleeve can lie upon and be pressed.

Figure 1A:
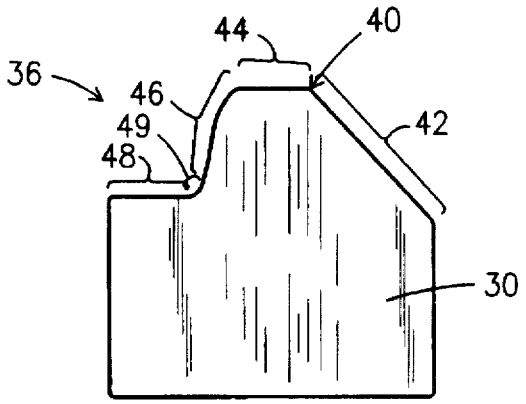
FIG. 1A is a top view of the planar configuration of a pressing surface of the invention that is formed in an arch shape for finishing the cuff and the pleats on the left sleeve of a shirt.
Figure 1B:
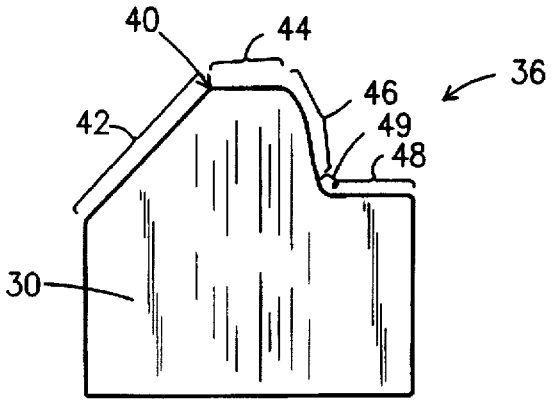
FIG. 1B is a top view of the configuration of a pressing surface of the invention that is formed in an arch shape for finishing the cuff and the pleats on the right sleeve of a shirt.
Figure 4A:
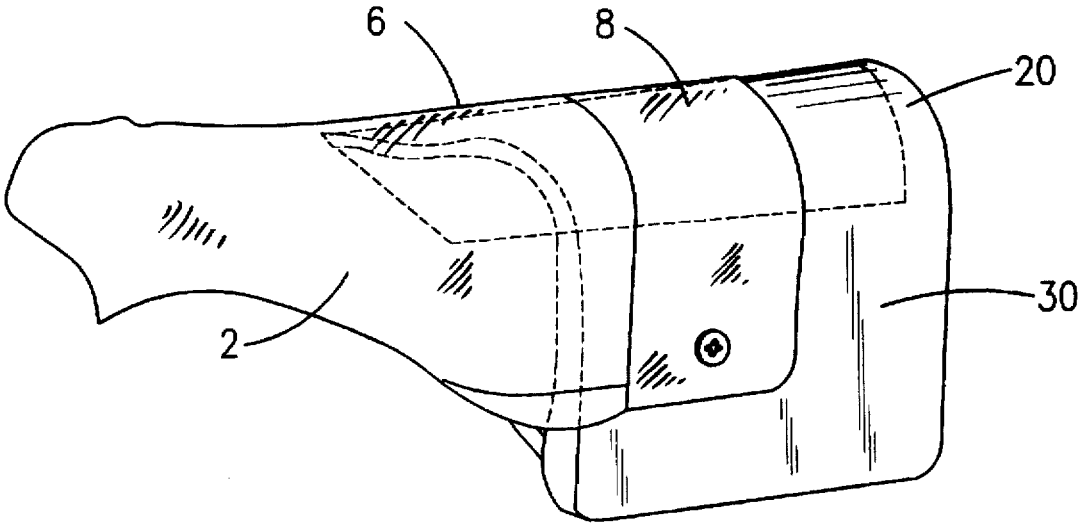
FIG. 4A is a view illustrating the dressing of a left shirt sleeve on a lower cuff chest of the invention.
Figure 4B:
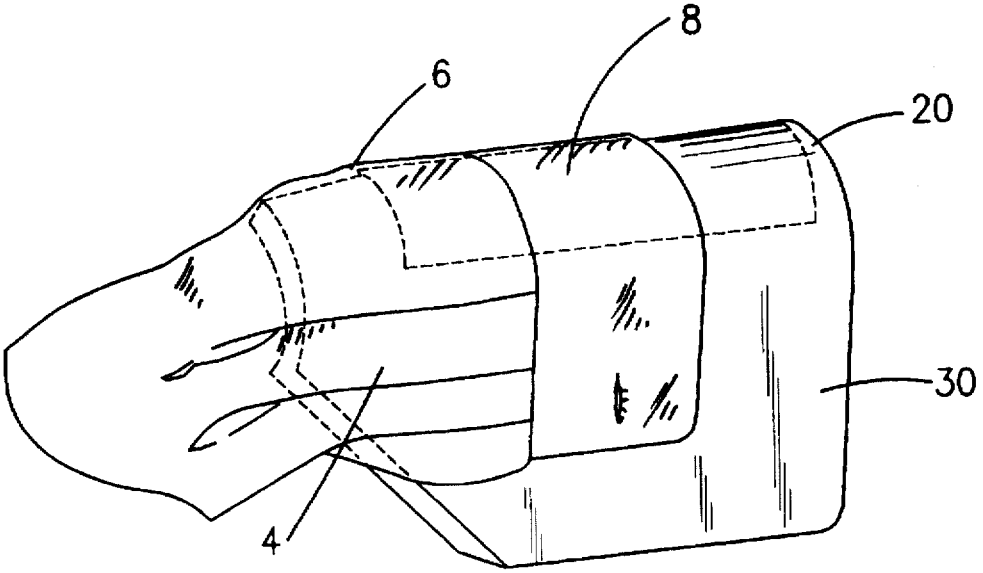
FIG. 4B is a view illustrating the dressing of a right shirt sleeve on a lower cuff chest of the invention.

In the preferred embodiment as shown in FIGS. 2A and 2B, the forwardly protruding pressing surface 30 of the lower cuff chest 20 is defined by a protruding portion 34 and a cut-out portion 36. The configuration of the desired pressing surface 30 of the lower cuff chest 20 is illustrated in FIGS. 1A and 1B. FIG. 1A illustrates a pressing surface 30 for the pressing of the left sleeve portion 6 and shirt cuff 8 and FIG. 1B illustrates a pressing surface 30 for pressing of the right sleeve portion 6 and shirt cuff 8. The advantage associated with this configuration is that the pleated portion 4 of the sleeve portion 6 is laid over the protruding portion 34 such that the pressing surface 30 can press the pleated portion 4. Moreover, the cut-out portion 36 provides relief for the extra material in the unpleated portion 2 of the sleeve portion 6 so that the unpleated portion 2 is not pressed upon closure of the upper cuff chest 22 with the lower cuff chest 20. FIG. 4A illustrates the placement of a cuff 8 and pleated portion 4 on a lower cuff chest 20 configured for a left sleeve portion 6 of a shirt. FIG. 4B illustrates the placement of a cuff 8 and pleated portion 4 on a lower cuff chest 20 configured for a right sleeve portion 6 of a shirt.

Figure 1C:
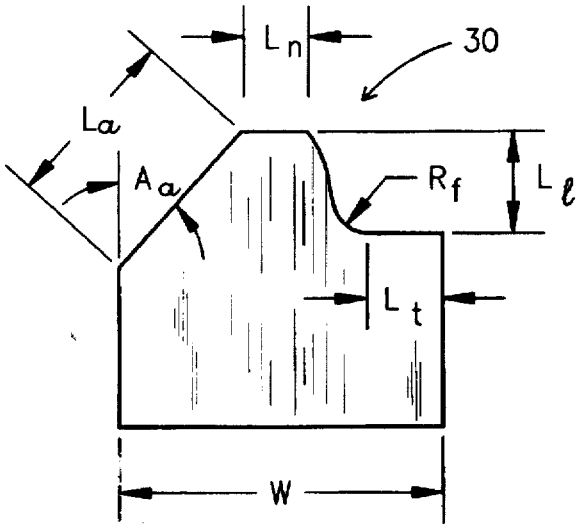
FIG. 1C is top view of the pressing surface for finishing the cuff and pleats on the right sleeve of a shirt showing in detail the various edges thereof.

In the preferred embodiment, the protruding portion 34 and cut-out portion 36 are defined by a front edge 40. The front edge 40 has an angled edge 42, a blunt-nose edge 44, a longitudinal edge 46 and a transverse edge 48. The longitudinal edge 46 extends arcuately from the blunt-nose edge 44. The front edge 40 also includes a fillet edge 49 positioned between the longitudinal edge 46 and the transverse edge 48. In the preferred embodiment as shown in FIG. 1C, the specifics of the forwardly protruding pressing surface are as follows: an angled edge 42 comprising a length $L_a$ of approximately 5.9 inches extending forwardly inwardly at an angle $A_a$ of approximately 42 degrees; a blunt-nose edge 44 comprising a length $L_n$ of approximately 2.1 inches; a longitudinal edge 46 comprising a length $L_1$ of approximately 4.0 inches; a transverse edge 48 comprising a length $L_t$ of approximately 3.5 inches; and a fillet edge 49 comprising a radius $R_f$ of approximately 1.9 inches.

Figure 3A:
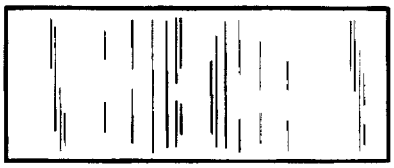
Fig. 3A PRIOR ART
FIG. 3A is a top view of the configuration of a prior art cuff chest without a forwardly protruding pressing surface.
Figure 3B:
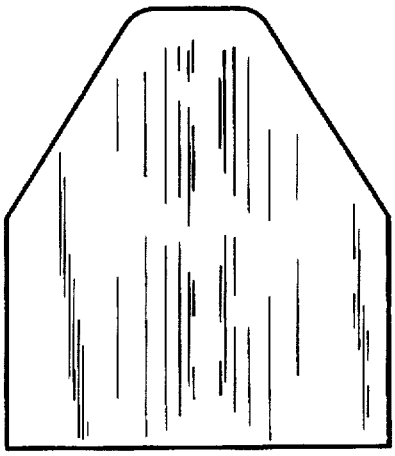
Fig. 3B PRIOR ART
FIG. 3B is a top view of the configuration of a prior art cuff chest with a forwardly protruding pressing surface and no cut-out portion.

The configuration of the chest of the present invention should be contrasted with the pressing surface of FIGS. 3A and 3B that illustrates the pressing surface without a cut-out portion.

In an alternative embodiment as shown in FIG. 2C, the upper cuff chest 22 has a similar configuration as that of the lower cuff chest 20. The arch-shaped pressing surface 30 of the upper cuff chest 22 is defined by a protruding portion 34 and a cut-out portion 36. The cut-out portion 36 of the upper cuff chest 22 aligns with the cut-out portion 36 of the lower cuff chest 20. In this embodiment, an additional direction of relief is provided for the gathering of extra material in the sleeve portion 6.

Figure 5:
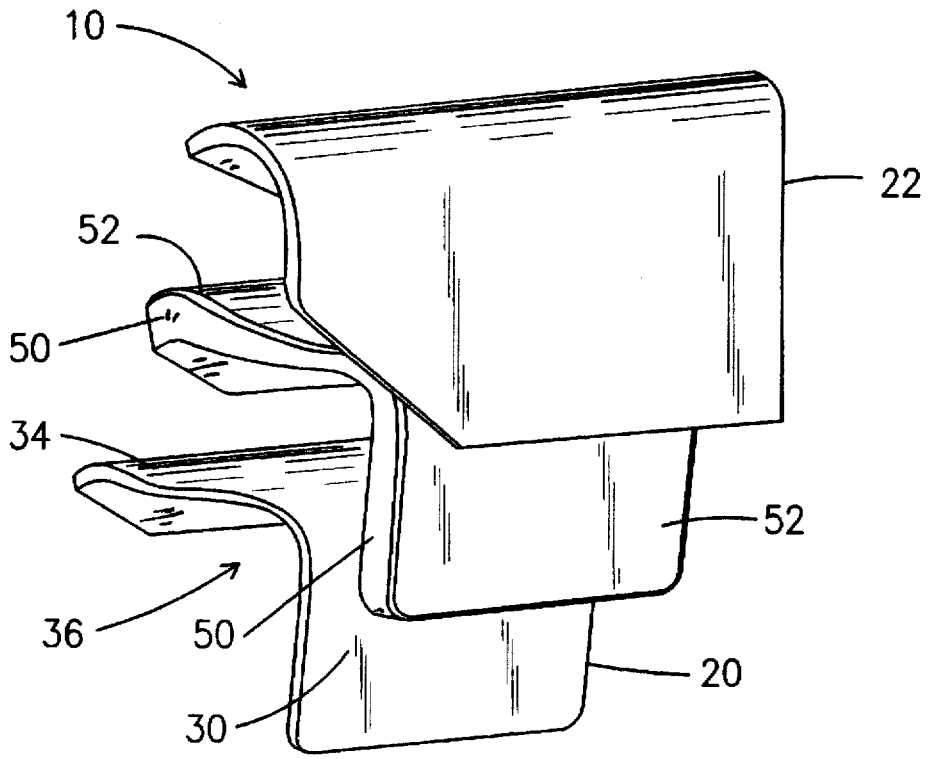
FIG. 5 is an exploded perspective view of an upper and lower cuff chest, base pad of the invention.

Continuing with the preferred embodiment, it is preferred that the lower cuff chest 20 include a base pad 50 of a resilient material such as wire mesh or silicon rubber conforming to the lower cuff chest 20 so that the pressure from pressing the shirt cuff 8 and pleated portion 4 is evenly dispersed over the pressing surface 30 of the lower cuff chest 20. Alternatively, a base pad of springs may be utilized to evenly disperse the pressure from pressing. It is preferred that the lower cuff chest 20 further include a second pad 52 conforming to the pressing surface 30 of the lower cuff chest 20 and placed on top of the base pad 50. Typically, this second pad 52 is made of silicon rubber, flannel or similar fabric. The combination of the base pad 50 and the second pad 52 help to eliminate any perfection in the laying of the shirt cuff 8 and pleated portion 4 on the pressing surface 30 of the lower cuff chest 20. Simply, the base pad 50 and the second pad 52 bridge any gaps in the material of the shirt cuff 8 and the pleated portion 4 between the pressing surface 30 of the lower cuff chest 20. The base pad 50 and second pad 52 formed to a lower cuff chest 20 is illustrated in FIG. 5.

Figure 6:
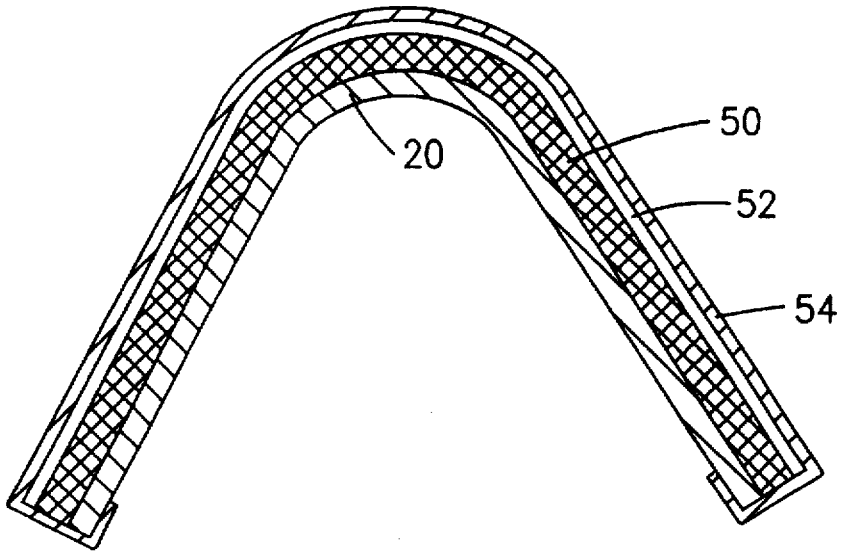
FIG. 6 is a cross-sectional view of a lower cuff chest having a conformed base pad, second pad and a cover.

It is further preferred that the second pad 52 and base pad 50 be covered by a cover 54 as shown in FIG. 6 so that a sacrificial material is placed over the base pad 50 and second pad 52 to produce a smooth finish. Another advantage associated with the base pad 50, second pad 52 and cover 54 is that the heat of the pressing surface 30 is generated upon the base pad 50, second pad 52 and cover 54 which keeps them dry. Consequently, the shirt cuffs 8 and pleated portion 4 are dried as well and therefore are pressed more effectively during finishing.

The present invention also includes the method of pressing a shirt cuff 8 and adjacent sleeve portion 6 that includes an unpleated portion 2 and a pleated portion 4. Such method includes the step of placing the shirt cuff 8 on a shirt pressing assembly 10 comprising of a lower cuff chest 20 of the present invention. The next step is aligning the pleated portion 4 on the protruding portion 34. The method then includes the step of gathering the unpleated portion 2 at the cut-out portion 36 so that the unpleated portion 2 is provided relief from the pressing surfaces 30. The upper and lower cuff chests 20 and 22 are mated together. The shirt cuff 8 and pleated portion 4 are pressed without also pressing the unpleated portion 2 of the sleeve portion 6. Finally, the upper and lower cuffs 20 and 22 are opened to allow removal of the shirt cuff 8 and pleated portion 4 from the shirt pressing assembly 10.

The present invention further comprises a method wherein the upper cuff chest 22 of the shirt pressing assembly 10 includes a forwardly protruding pressing surface 30 defined by a protruding portion 34 and a cut-out portion 36 as does the lower cuff chest 20 such that relief for the unpleated portion 2 is provided.

The previously described embodiments of the present invention have many advantages, including eliminating wrinkled pleats on a shirt sleeve. The present invention facilitates ease in placing a shirt cuff and sleeve portion on a cuff chest as well as the pressing of the pleated portion of the sleeve.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A shirt cuff pressing assembly for pressing a shirt cuff and adjacent sleeve portion of a shirt, said sleeve portion having a pleated portion and an unpleated portion, said shirt cuff pressing assembly comprising in combination:

a lower and an upper cuff chest, said lower and upper cuff chests having mating arch-shaped pressing surfaces allowing said lower cuff chest to be dressed with the shirt cuff and the shirt cuff pressed by said pressing surfaces upon mating closure of said cuff chests; and said pressing surfaces of said cuff chests including forwardly protruding pressing surfaces, said forwardly protruding pressing surface of said lower cuff chest being defined by a protruding portion and a cut-out portion, said cut-out portion providing relief for gathering of the unpleated portion of the sleeve portion when said lower cuff chest is dressed with the shirt cuff, thereby allowing the pleated portion of the sleeve portion to be pressed by said forwardly protruding pressing surfaces of said cuff chests upon closure of said cuff chests without pressing of said unpleated portion of the sleeve portion.

2. The shirt cuff pressing assembly as set forth in claim 1, wherein said protruding and cut-out portions of said lower cuff chest are defined by a front edge of said lower cuff chest having an angled edge, a blunt-nose edge, a longitudinal edge and a transverse edge.

3. The shirt pressing assembly as set forth in claim 2, wherein said front edge of said lower cuff chest is further defined by a fillet edge positioned between said longitudinal edge and said transverse edge.

4. The shirt pressing assembly as set forth in claim 2, wherein said longitudinal edge extends arcuately from said blunt-nose edge.

5. The shirt cuff pressing assembly as set forth in claim 2, wherein said angled edge comprises a length of approximately 5.9 inches extending forwardly inwardly at an angle of approximately 42 degrees, wherein said blunt-nose edge comprises a length of approximately 2.1 inches, said longitudinal edge comprises a length of approximately 4.0 inches and said transverse edge comprises a length of approximately 3.5 inches.

6. The shirt pressing assembly as set forth in claim 5, wherein said front edge of said lower cuff chest is further defined by a fillet edge positioned between said longitudinal edge and said transverse edge, said fillet edge having a radius of approximately 1.9 inches.

7. The shirt pressing assembly as set forth in claim 1, wherein said forwardly protruding pressing surface of said upper cuff chest being defined by a protruding portion and a cut-out portion, said cut-out portion providing of the unpleated portion of the sleeve portion when said lower cuff chest is dressed with the shirt cuff, thereby allowing the pleated portion of the sleeve portion to be pressed by said forwardly protruding pressing surfaces of said cuff chests upon closure of said cuff chests without pressing of said unpleated portion of the sleeve portion.

8. The shirt pressing assembly as set forth in claim 7, wherein said protruding and cut-out portions of said upper cuff chest are defined by a front edge of said upper cuff chest having an angled edge, a blunt-nose edge, a longitudinal edge and a transverse edge.

9. The shirt pressing assembly as set forth in claim 8, wherein said front edge of said upper cuff chest is further defined by a fillet edge positioned between said longitudinal edge and said transverse edge.

10. The shirt pressing assembly as set forth in claim 8, wherein said longitudinal edge extends arcuately from said blunt-nose edge.

11. The shirt cuff pressing assembly as set forth in claim 8, wherein said angled edge comprises a length of approximately 5.9 inches extending forwardly inwardly at an angle of approximately 42 degrees, wherein said blunt-nose edge comprises a length of approximately 2.1 inches, said longitudinal edge comprises a length of approximately 4.0 inches and said transverse edge comprises a length of approximately 3.5 inches.

12. The shirt pressing assembly as set forth in claim 11, wherein said front edge of said upper cuff chest is further defined by a fillet edge positioned between said longitudinal edge and said transverse edge, said fillet edge having a radius of approximately 1.9 inches.

13. The shirt cuff pressing assembly as set forth in claim 1, wherein said lower cuff chest further comprises a base pad conformed to said pressing surface.

14. The shirt cuff pressing assembly as set forth in claim 13, wherein said lower cuff chest further comprises a second pad conformed to said base pad.

15. The shirt cuff pressing assembly as set forth in claim 14, wherein said lower cuff chest further comprises a cover conformed to said second pad.

16. The shirt cuff pressing assembly as set forth in claim 13, wherein said base pad is substantially wire mesh.

17. The shirt cuff pressing assembly as set forth in claim 14, wherein said second pad is substantially flannel.

18. The shirt cuff pressing assembly as set forth in claim 15, wherein said cover is substantially cloth.

19. A method of pressing a shirt cuff and adjacent sleeve portion of a shirt, said sleeve portion having a pleated portion and an unpleated portion, said method comprising the steps of:

placing said shirt cuff on a shirt pressing assembly comprising in combination:

a lower and an upper cuff chest, said lower and upper cuff chests having mating arch-shaped pressing surfaces allowing said lower cuff chest to be dressed with the shirt cuff and the shirt cuff pressed by said pressing surfaces upon mating closure of said cuff chests; and said pressing surfaces of said cuff chests including forwardly protruding pressing surfaces, said forwardly protruding pressing surface of said lower cuff chest being defined by a protruding portion and a cut-out portion, said cut-out portion providing relief for gathering of the unpleated portion of the sleeve portion when said lower cuff chest is dressed with the shirt cuff, thereby allowing the pleated portion of the sleeve portion to be pressed by said forwardly protruding pressing surfaces of said cuff chests upon closure of said cuff chests without pressing of said unpleated portion of the sleeve portion;

aligning said pleated portion on said protruding portion;

gathering said unpleated portion at said cut-out portion;

closing said upper and lower cuff chests such that said pressing surfaces are mated;

pressing said shirt cuff and said pleated portion without pressing said unpleated portion of the sleeve portion; and opening said upper and lower cuff chests such that said pressing surfaces are no longer mated, whereby the shirt cuff and the sleeve portion may be removed from said shirt cuff pressing assembly.

20. The method as set forth in claim 19, wherein said forwardly protruding pressing surface of said upper cuff chest being defined by a protruding portion and a cut-out portion, said cut-out portion providing of the unpleated portion of the sleeve portion when said lower cuff chest is dressed with the shirt cuff, thereby allowing the pleated portion of the sleeve portion to be pressed by said forwardly protruding pressing surfaces of said cuff chests upon closure of said cuff chests without pressing of said unpleated portion of the sleeve portion.

* * * * *